US006223918B1

(12) United States Patent
Browne

(10) Patent No.: US 6,223,918 B1
(45) Date of Patent: May 1, 2001

(54) PACKAGE

(75) Inventor: Martin Browne, Oslo (NO)

(73) Assignee: Nycomed Imaging AS, Oslo (NO)

( * ) Notice: Subject to any disclaimer, the term of this patent is extended or adjusted under 35 U.S.C. 154(b) by 0 days.

(21) Appl. No.: 09/525,756

(22) Filed: Mar. 14, 2000

Related U.S. Application Data

(63) Continuation of application No. PCT/GB99/02264, filed on Jul. 14, 1999.
(60) Provisional application No. 60/101,205, filed on Sep. 21, 1998.

(30) Foreign Application Priority Data

Jul. 14, 1998 (GB) ..... 9815291

(51) Int. Cl.[7] ..... B65D 51/20
(52) U.S. Cl. ..... 215/249; 215/251; 215/254
(58) Field of Search ..... 215/249, 251, 215/247, 277, 274, 276, 254; 604/403, 415

(56) References Cited

U.S. PATENT DOCUMENTS

| | | | | |
|---|---|---|---|---|
| D. 392,046 | | 3/1998 | Niedospial, Jr. . | |
| 2,465,269 | * | 3/1949 | Rohde et al. | 215/249 |
| 3,578,223 | | 5/1971 | Armour et al. . | |
| 3,888,377 | * | 6/1975 | Stadler | 215/249 |
| 4,181,232 | | 1/1980 | Bellamy et al. . | |
| 5,048,706 | | 9/1991 | de Vaujany . | |
| 5,316,163 | * | 5/1994 | von Schuckmann | 215/249 |
| 5,344,036 | | 9/1994 | Stanescu et al. . | |
| 5,379,908 | * | 1/1995 | Rohe | 215/249 |
| 5,678,713 | | 10/1997 | Derksen . | |
| 5,680,945 | | 10/1997 | Sander et al. . | |
| 5,957,314 | * | 9/1999 | Nishida et al. | 215/249 |

FOREIGN PATENT DOCUMENTS

| | | |
|---|---|---|
| 195 00 460 A1 | 7/1996 | (DE) . |
| 0 079 676 A2 | 5/1983 | (EP) . |
| 0 480 196 A1 | 9/1991 | (EP) . |
| 0 358 583 B1 | 7/1992 | (EP) . |
| 0 769 456 A2 | 4/1997 | (EP) . |
| 0 769 456 A3 | 7/1997 | (EP) . |
| 0 794 129 A1 | 9/1997 | (EP) . |
| 0 805 113 A1 | 11/1997 | (EP) . |
| 0 819 617 A1 | 1/1998 | (EP) . |
| 2 415 055 | 8/1979 | (FR) . |
| 2 745 793 | 9/1997 | (FR) . |

OTHER PUBLICATIONS

Sales Brochure: STELMI Trading International; Revolution! Stemli Caps; 2pg brochure (undated).

* cited by examiner

*Primary Examiner*—Nathan J. Newhouse
(74) *Attorney, Agent, or Firm*—Bacon & Thomas

(57) ABSTRACT

A package (10) includes a plastic bottle (20), a stopper (40) removably inserted into the mouth of the bottle, and a plastic cap (50). The cap has a cover member (52) which overlies the stopper and has a region (66) which is removable to expose the upper surface of the stopper to allow piercing thereof by a needle or the like. The removable region is provided with a pull-ring (68) protected from accidental operation by an annular wall (60) projecting upwardly from the edge of the cover member (52).

15 Claims, 5 Drawing Sheets

PACKAGE

This application is a continuation of International Patent Application No. PCT/GB99/02264 filed Jul. 14, 1999 claiming priority of U.S. Provisional Patent Application No. 60/101,205 filed Sep. 21, 1998.

The present invention relates to a package, and more particularly to a package for sterile fluids.

In the medical field, sterile fluids, such as medicaments, pharmaceuticals, sterile saline solution and so on are frequently required for the treatment of patients. Such sterile fluids are normally supplied in bottles made of glass, which is chemically inert and highly unlikely to contaminate or otherwise adulterate the sterile fluid.

The glass bottles are normally closed by a rubber stopper inserted into the mouth of the bottle. The stopper is designed so that it can be pierced by a needle of a hypodermic syringe, an infusion spike of an infusion set, or the like, to allow the contents of the bottle to be withdrawn. The stopper can also be removed to allow the contents of the bottle to be poured out.

In order to hold the stopper in place, a cap made of aluminium or similar thin sheet metal is crimped over the stopper and the upper part of the bottle. In order to gain access to the stopper, either to pierce it or remove it, the cap is either partially or totally torn away.

Such a package, although in wide use, has a number of disadvantages. For example, glass bottles tend to be relatively heavy. Further, glass is a relatively fragile material, and glass bottles are prone to breakage. This is particularly true when the volume of the bottle exceeds 100 ml. In order to reduce the incidence of breakage during shipping, such glass bottles must be packed carefully, with inserts separating the bottles from each other. Since such inserts take up a certain volume, the number of bottles which can be accommodated in a given volume is reduced, and thus the cost of transporting the bottles is increased.

In addition, tearing the aluminium cap away can cause problems, as sharp edges are left where the cap is torn. These edges are sharp enough to puncture surgical gloves and human skin, which is obviously a disadvantage in the medical field in particular, where the risk of infection must be kept to a minimum.

In addition, in many European countries, waste must be sorted by nature before being disposed of. Having a metal cap and a rubber stopper on a glass bottle means that the package contains three different sorts of material (glass, metal and plastics), which must be disposed of separately.

Alternative approaches to containers for sterile fluids have also been tried, with varying degrees of success. In one known product, plastic bottles with screw caps are used, the screw caps having stoppers attached thereto. When the screw cap is removed, the stopper is also removed from the bottle. While this avoids the problems associated with the use of glass bottles, the package is not compatible with infusion procedures, and cannot be used with hypodermic needles as the standard packages can.

In another proposal, described in DE 19500460, a plastic bottle is provided with an injection moulded cap which is covered by a plastic foil. In this proposal there is no stopper in the mouth of the bottle and the primary sealing of the bottle is by an integrally moulded closure wall which is piercable by a cannula or spike but not otherwise openable. The cap fits over the closure wall. When it is desired to access the contents of the bottle the foil is removed and both the cap and the closure wall must be pierced, requiring sufficient force to penetrate both these parts and with a possible risk of the cannula or spike being plugged by the material of the closure wall, or coring that material to create particles in the contents of the bottle.

It is also known to use plastic bottles with traditional stoppers, retained by aluminium caps. These still have the problems of needing to sort the various parts of the package before they can be discarded as waste, and of leaving sharp edges when the aluminium cap is torn.

Further types of closure, manufactured by Stelmi of France, are marketed under the name of "Monobloc" and "Duobloc". The "Monobloc" comprises a plastics cap which fits over the neck and stopper of a traditional glass bottle. A tear-off portion allows access to the stopper, and the entire cap can be removed if necessary. The "Duobloc" is similar, but has a screw-threaded insert which snaps over the neck of the glass bottle, and the remainder of the cap is threadedly engaged with the insert. However, both use glass bottles with their attendant problems, and the various parts of the package must be sorted before the package can be disposed of.

According to a first aspect of the invention, there is provided a package comprising a container with a mouth, a stopper inserted into said mouth, and a cap overlying said stopper, wherein said container and said cap are formed from plastics material.

By forming the container and cap of the package from plastics material, the problems of weight and breakage associated with glass containers are avoided. Further, there is no need to sort the container and cap parts of the package into glass, metal and plastics before it is discarded.

The stopper will generally be formed of an elastic material and is preferably also formed from plastics. The stopper may be formed from rubber.

In one preferred embodiment, the container is a bottle. This is preferable as sterile fluids are routinely supplied in glass bottles, and it is desirable to avoid any confusion on the part of the end-user by supplying material in much the same format, even if the package is formed from different materials.

Preferably, the container and the cap have complementary screw threads. This provides a simple and effective way of securing the cap on the container.

It is further preferred that the cap be provided with a tamper-evident feature, to reduce the risk of fluid being administered from a package which has been opened and then reclosed. Such opening and reclosing can result in the fluid losing its sterility, or in adulteration or contamination of the fluid in some form. One suitable form of tamper-evident feature is a member removably attached to the cap, which must be detached from the cap before the cap can be removed. The absence of the member is then a sign that the package has been opened at some time, and should not be used.

In a preferred embodiment, the cap comprises a removable portion which can be removed to gain access to the stopper.

With such a cap, the closure can be opened in a number of ways. The removable portion can be removed to gain access to the stopper, whilst leaving the stopper in place. The stopper can then be pierced by a hypodermic needle or similar. Alternatively, the entire cap can be removed (which may entail removal of a tamper-evident feature), which then allows access to the entire stopper. This may be useful if, for example, an infusion spike which is wider than the removable portion is to be used. As a further alternative, the entire cap and the stopper can be removed, to enable pouring or the insertion of a quill or straw to load an autoinjector.

Preferably, the cap has an engageable member for operation by a user to remove the removable portion. This facilitates removal of the removable portion.

In preferred arrangements the engageable member comprises a ring upwardly spaced from the removable portion. This allows the user of the package to hook a finger beneath the engageable member, and thus makes it easier to operate.

It is further preferred that the cap also comprises at least one projection which acts as a pivot for the engageable member. If a pivot is not used, then the force exerted on the engageable member by the user is simply transmitted to the removable portion. However, if a pivot point is provided, then a leverage effect can allow the force exerted on the engageable member to be amplified, thus making it easier to remove the removable portion.

In preferred embodiments the engageable member projects from the cap, and there is thus a risk that the member could snag on something and accidentally be operated to remove the removable region. Preferably, therefore, the cap is also provided with a wall which extends generally about the periphery of the engageable member to protect it from accidental operation or entanglement, e.g. with other packages. As a result, the engageable member is "shrouded", and there is less chance that the member can be accidentally operated. If the engageable member is a pull ring, it is advantageous for such a pull ring to be protected around its entire circumference.

It is further preferred that the wall has at least one opening therethrough. Most packages of sterile fluid for medical use are sterilized by autoclaving in a steam atmosphere, and the steam can condense into water on the package as the atmosphere in the autoclave cools. If the wall is unbroken, then it can form a cup in which the water collects. Providing an opening in the wall allows the water to escape.

Preferably, the cap is provided with a member which engages with the stopper when the package is closed to protect a defined region of the stopper from contamination. The member is advantageously an annular member which extends downwardly from the cap and engages with the upper surface of the stopper. The annular member then provides a physical barrier to contaminants and helps keep the defined region sterile. The integrity of a seal created by the member is preferably achieved by the member resiliently deforming the part of the stopper against which it engages.

The idea of providing a wall to protect the engageable member from accidental actuation is considered to be of independent inventive merit, and so according to a second aspect of the invention, there is provided a package comprising a container with a mouth, a stopper removably inserted into said mouth, and a cap overlying said stopper, wherein said cap comprises a removable portion which can be removed to gain access to said stopper, an engageable member for operation by a user to remove the removable portion, and a wall extending generally about the periphery of the engageable member to protect it from accidental operation or entanglement.

It is further preferred that the wall has at least one opening therethrough, for the reasons discussed above.

In a further preferred embodiment, the mouth has an internal diameter, and the container has a region below the mouth having an internal diameter less than the internal diameter of the mouth. The constriction so formed helps to prevent the stopper from being pushed into the container when a force is applied to it, for example by a hypodermic syringe or the like. As the stopper is pushed downwardly, it abuts on the constriction, and this prevents further downward movement.

The idea of providing such a constriction is considered to be independent inventive merit, and so according to a third aspect of the present invention, there is provided a package comprising a container with a mouth for receiving a stopper, the mouth having an internal diameter, the container having a region below said mouth having an internal diameter less than the internal diameter of said mouth, such that the stopper is prevented from moving from said mouth into said region.

Preferred embodiments of the invention will now be described by way of example only and with reference to the accompanying drawings, in which.

Figure 1:
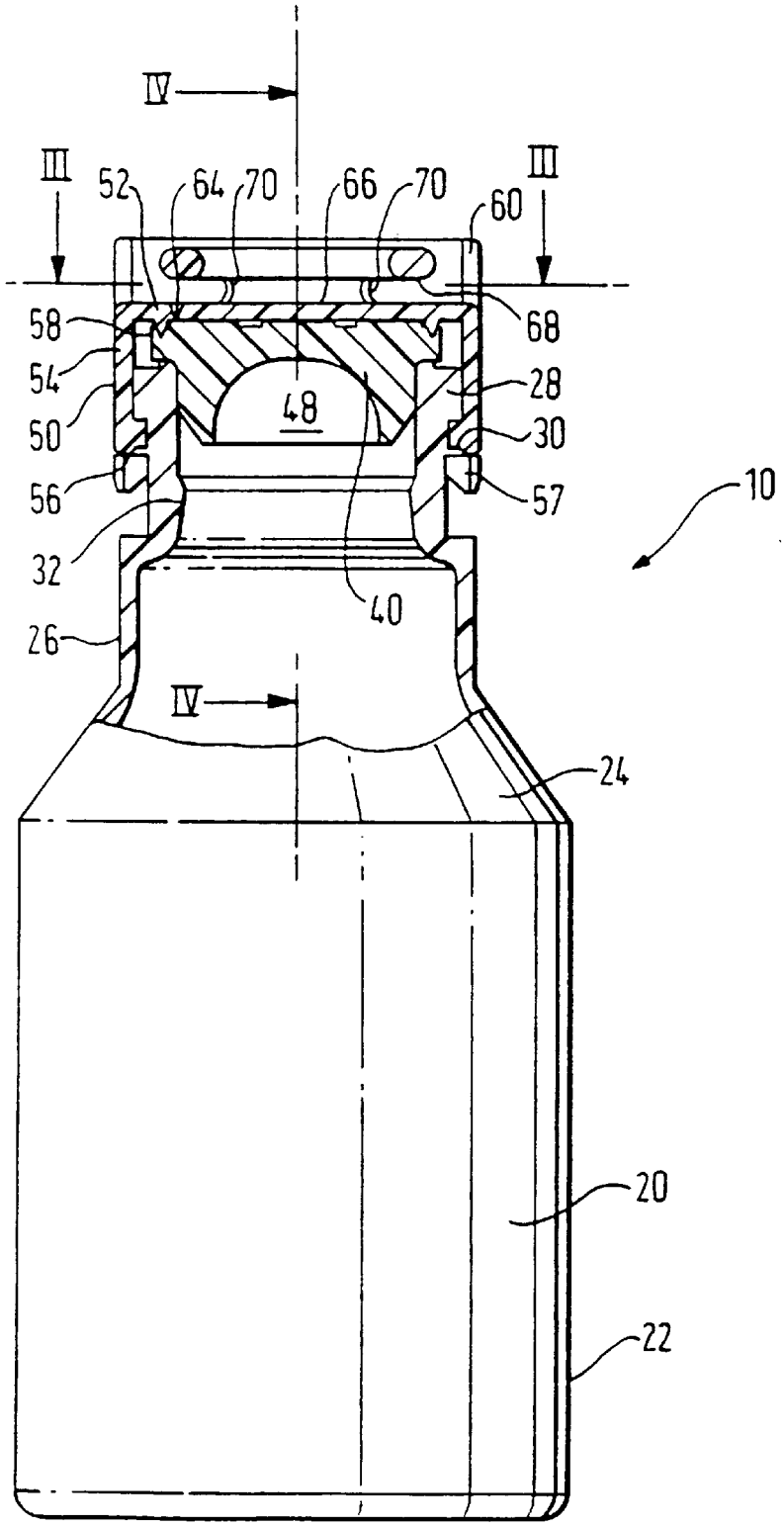
FIG. 1 is a side view, partially broken away, of a package according to a first embodiment of the invention.
Figure 2:
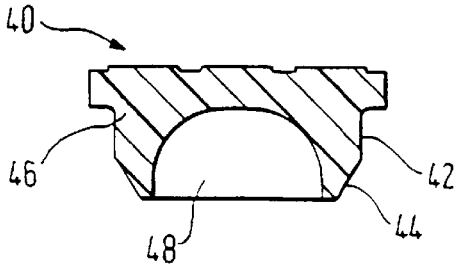
FIG. 2 is a cross-sectional view of the stopper.
Figure 3:
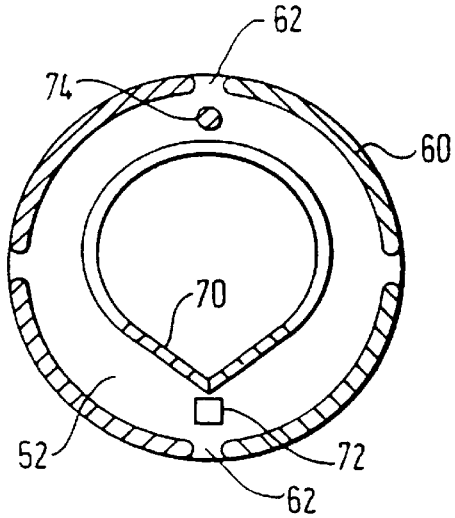
FIG. 3 is a cross-sectional view along line III—III in FIG. 1.

FIG. 1 shows a package 10 according to a first embodiment of the invention. The package 10 comprises a plastics bottle 20, a stopper 40 and a plastics closure cap 50. The stopper is preferably formed from a thermoplastic polymer material, but may be formed from other synthetic polymer materials or synthetic rubber (e.g. chlorobutyl rubber) or natural rubber.

The bottle 20 has a body 22, a shoulder portion 24, and a narrowed neck portion 26 extending from the shoulder portion. The outer surface of the neck has an external screw thread 28 formed thereon. A lip 30 projects radially outwardly from the neck 26 below the external screw thread 28.

Figure 9:
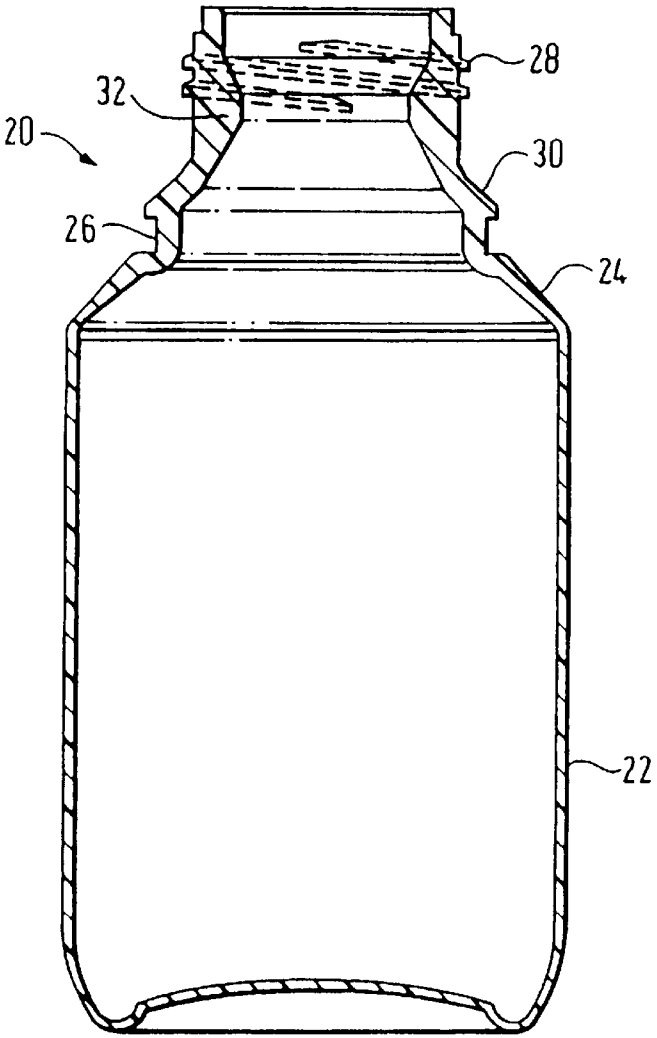
FIG. 9 is a cross-sectional view of an alternative bottle.
Figure 10:
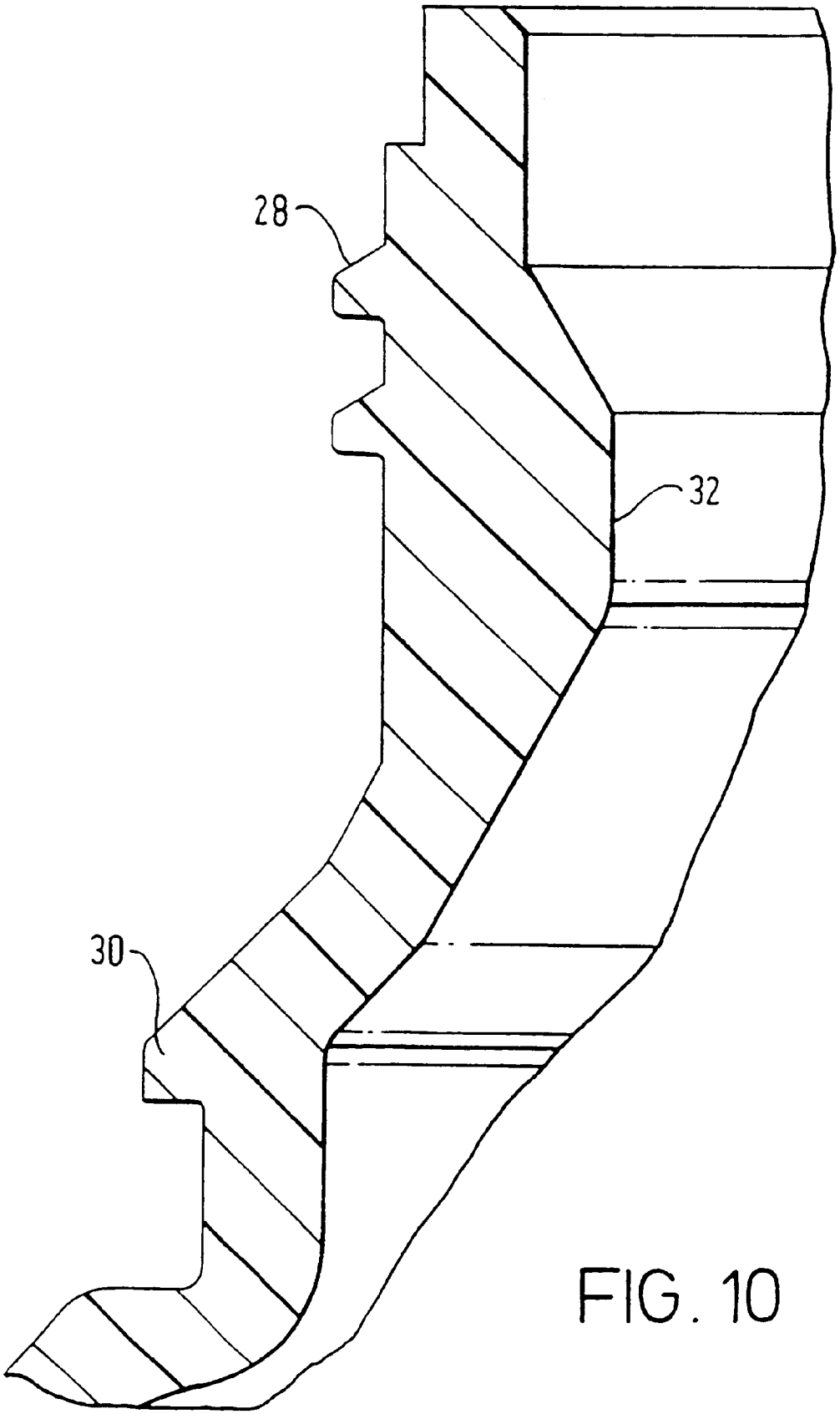
FIG. 10 is a view on an enlarged scale of a portion of FIG. 9.

The inner surface of the neck is substantially cylindrical. However, the inner surface also has a portion 32 of reduced diameter. The purpose of this portion is to prevent the stopper 40 from being pushed into the neck 26 when a force is applied to the stopper, for example by a hypodermic needle or the like. The portion can have a diameter only slightly less than that of the remainder of the neck, as shown in FIG. 1, or the diameter can be substantially less, as shown in FIGS. 9 and 10.

The stopper 40 has a generally cylindrical body 42, and the radius of the body is slightly greater than the radius of the inner surface of the neck of the bottle. This allows the body 42 of the stopper 40 to be an interference fit in the neck 26 of the bottle. The stopper thus seals the bottle. The lower end of the body 42 has a chamfer 44, to aid insertion of the body 42 into the neck 26 of the bottle 20.

At the upper end of the body 42 is a flange 46. The flange 46 rests on the top of the neck of the bottle when the stopper 40 is fully inserted thereinto.

In addition, the lower surface of the stopper 40 is formed with a hollow 48 therein. The hollow 48 extends upwardly from the lower surface towards the top of the stopper 42, and as a result the thickness of the central portion of the stopper 42 is considerably less than the length of the stopper. This makes it easier for the stopper to be pierced by a hypodermic needle, an infusion spike or the like.

The closure cap 50 is attached to the upper part of the neck 26 of the bottle. The cap has a cover member 52 which overlies the stopper 40, and an annular skirt 54 extending downwardly from the edge of the cover member 52.

The skirt 54 has an internal screw thread 56 formed on its inner surface, and the internal screw thread 56 engages with the external screw thread 28 formed on the neck 26 of the bottle to retain the closure in place.

Detachably attached to the lower end of the skirt 54 is a ring 57. The ring 57 engages beneath the lip 30 on the neck 26 of the bottle. The detachable ring 57 thus serves as a tamper-evidencing element. In order to remove the cap 50 from the bottle 20, it is first necessary to detach the ring 57 from the cap 50, and the detached ring makes it clear to the user that the package 10 has been opened.

The underside of the cover member 52 has an annular member 58 extending downwardly from it. The lower end of the annular member engages with the upper surface of the stopper 40 and helps to ensure the integrity of the package 10. In addition, the annular member 58 surrounds a central region of the upper surface of the stopper, and helps to prevent contamination of it. As the central region of the upper surface of the stopper is the part which is contacted by a needle or the like when the stopper is punctured, provision of the annular member 58 also helps to safeguard the overall sterility of the package.

Projecting upwardly from the edge of the cover member 52 is a generally annular wall 60, whose circumference matches that of the cover member 52. The annular wall 60 is formed with a number of openings 62 (four in the illustrated embodiment), and thus can also be thought of as four separate arcuate walls. The purpose of the openings 62 is to allow any liquid on top of the cover member 52 to drain away. Packages of sterile fluid are frequently autoclaved to ensure sterility, and it is quite possible for steam from the autoclave to condense on the packages during the cooling phase. If the annular wall 60 did not have any openings 62 in it, it would form a cup in which any condensed water would be retained. It would then be necessary to invert the package to remove the water or to rely on evaporation. Forming the annular wall 60 with openings 62 allows the water to simply drain out. The drainage of water can be assisted by forming the member 52 in such a manner that it is not planar, for example by having the central part of the member projecting above the peripheral region.

The upper surface of the cover member 52 is formed with a line of weakness 64 around a region 66. The line of weakness facilitates the removal of the region 66. Removal of this region 66 exposes the upper surface of the stopper 40, which can then be punctured by a hypodermic needle or the like.

In order to allow the region 66 to be removed, a pull-ring 68 is attached to it by legs 70 which extend from the region 66 of the cover member 52 bounded by the line of weakness 64 to one side of the pull-ring 68. The legs, the pull-ring and the annular wall are arranged so that the upper surface of the pull-ring 68 is below the topmost surface of the annular wall 60. This affords protection for the pull-ring 68, preventing its accidental operation and consequent damage to the closure.

The upper surface of the cover member 52 is also provided with two upstanding members 72, 74, disposed at diametrically opposite sides of the ring, one (72) adjacent to where the legs 70 attach to the pull-ring 68 and one (74) opposite thereto. The upstanding members 72, 74 are dimensioned such that their uppermost ends are disposed just beneath the pull-ring 68. The upstanding member 74 maintains the part of the pull-ring 68 remote from the legs at an upward spacing from the cover member 52, so as to assist access when it is desired to lift the pull ring. The pull-ring 68 and the projection 74 are formed integrally and are thus connected by a frangible bridge. The connection between the ring and the projection means that extra force has to be applied to separate them before the ring can be lifted to open the container, and the need for this extra force reduces the likelihood of accidental opening. The connection may however be omitted in alternative embodiments.

Figure 4:
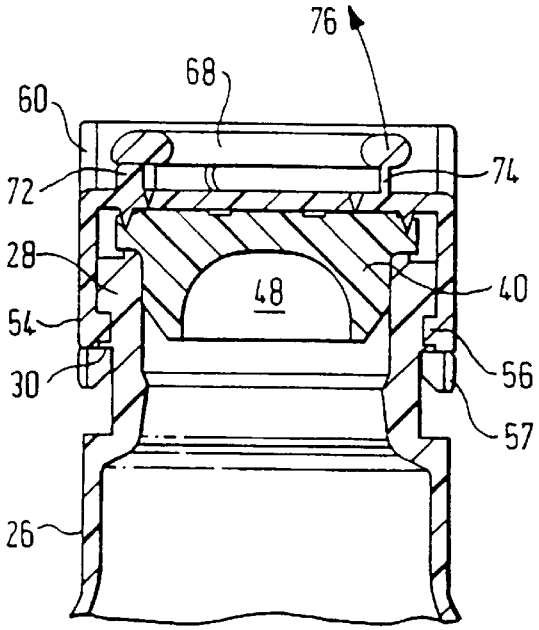
FIG. 4 is a cross-sectional view along line IV—IV in FIG. 1.

The upstanding member 72 which is nearer to the point where the legs 70 attach to the pull-ring 68 serves as a pivot member for the pull-ring 68, to assist in removing the region 66. When the free side of the ring (ie the side furthest from where the legs are attached) is lifted, as shown by the arrow 76 in FIG. 4, the lower surface of the ring 68 contacts the upper surface of the upstanding member 72 and pivots about it. Since the ring 68 is pivoting about a point at its edge, the whole of the ring 68 is lifted by the force applied to it by the user, and in particular the part of the ring to which the legs 70 are attached moves away from the cover member 52. The legs thus pull on the region 66 of the cover member 52 which is bounded by the line of weakness 64, and tend to pull it away from the remainder of the cap 50. Further, the leverage resulting from the use of the pivot increases the force applied to the cover member 52 by the legs 70, and further aids the removal of the region 66 of the cover member.

When the region 66 of the cover member 52 is removed, it leaves an opening in the cover member, exposing the stopper 40. The edges of this opening, and the edges of the portion which has been torn away, are formed from torn plastics material, and are far less sharp than similar edges formed from torn metal. The risk of a user cutting themselves on the edges, and the risk of infection associated with such cuts, is thus considerably reduced.

The package 10 can be opened in different ways. First, as described above, the pull-ring 68 can be used to remove the region 66 of the cover member 52 bounded by the line of weakness 64, by lifting and pulling the ring 68. This exposes a portion of the surface of the stopper 40, which can then be punctured by a hypodermic needle or an infusion spike or the like to gain access to the contents of the package 10. Once sufficient of the contents have been removed, the entire package (comprising the bottle 20, the stopper 40 and the remainder of the cap 50) can then be discarded. As the entire package is formed from plastics material, there is no need to sort the various parts for recycling or waste disposal.

Second, the cap 50 itself can be removed, followed by removal of the stopper 40. This requires the removal of the detachable ring 56 from the bottom of the skirt 54 of the cap 50, which can then be unscrewed and discarded. The stopper is removed and this allows the contents of the bottle to be poured out, or a quill or straw of e.g. an autoinjector to be inserted. Again, once the contents of the package 10 have been removed, the package can be discarded without sorting.

As the container and cap parts of the package 10 are entirely formed from plastics material, it has a number of advantages over previous packages. For example, the plastic bottle is both lighter and less prone to breakage than a corresponding glass bottle would be. As a result, less precautions must be taken when shipping the package, and so less secondary packing material, and also less space for a given number of packages, is required. In addition, there is no need to sort the container and cap parts of the package before it is disposed of. There is also less risk of injury from the torn regions of the cap, as they are torn plastics material rather than torn metal.

Figure 5:
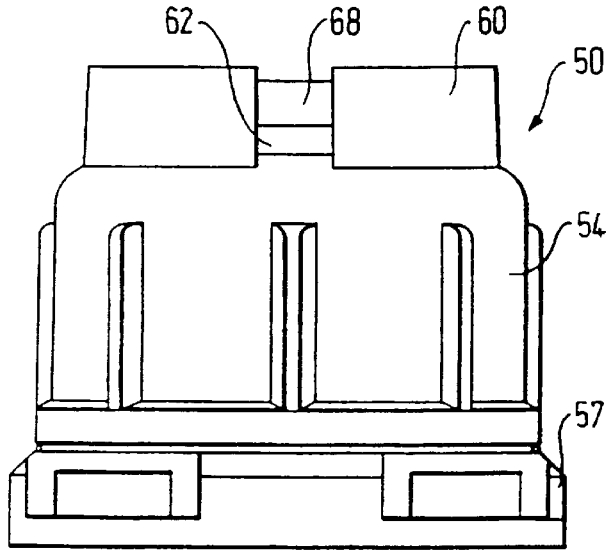
FIG. 5 is a side view of a cap for use in a package according to a second embodiment of the invention.
Figure 6:
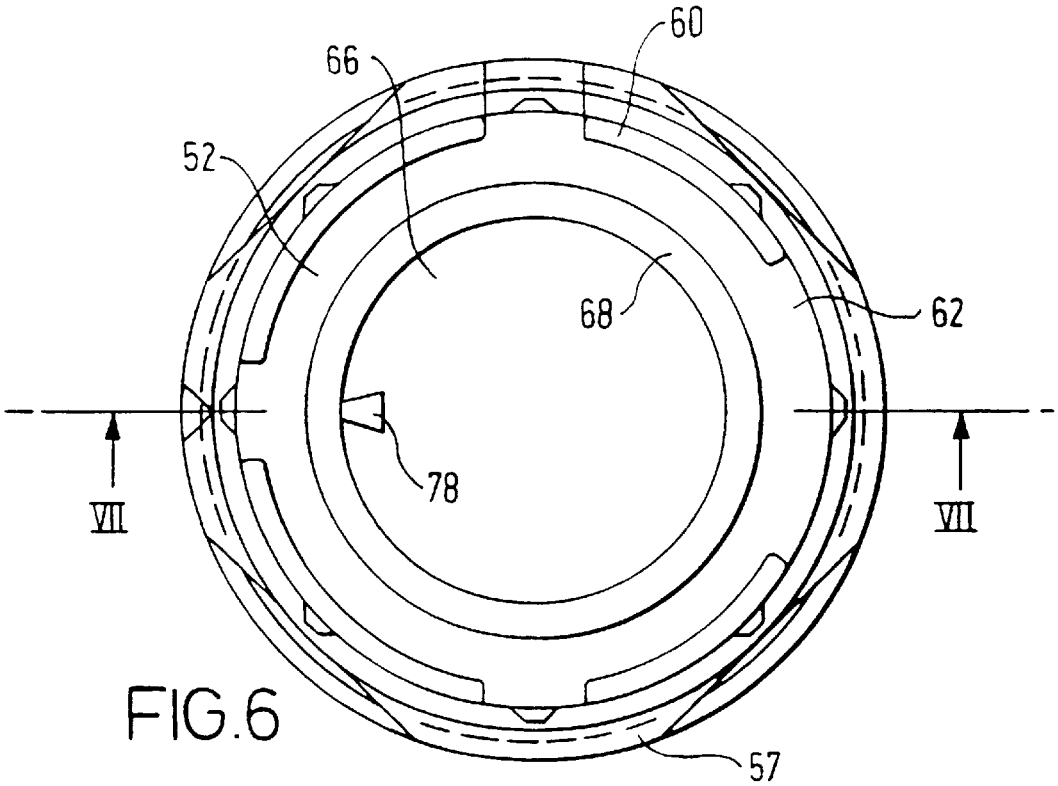
FIG. 6 is a plan view of the cap of FIG. 5.
Figure 7:
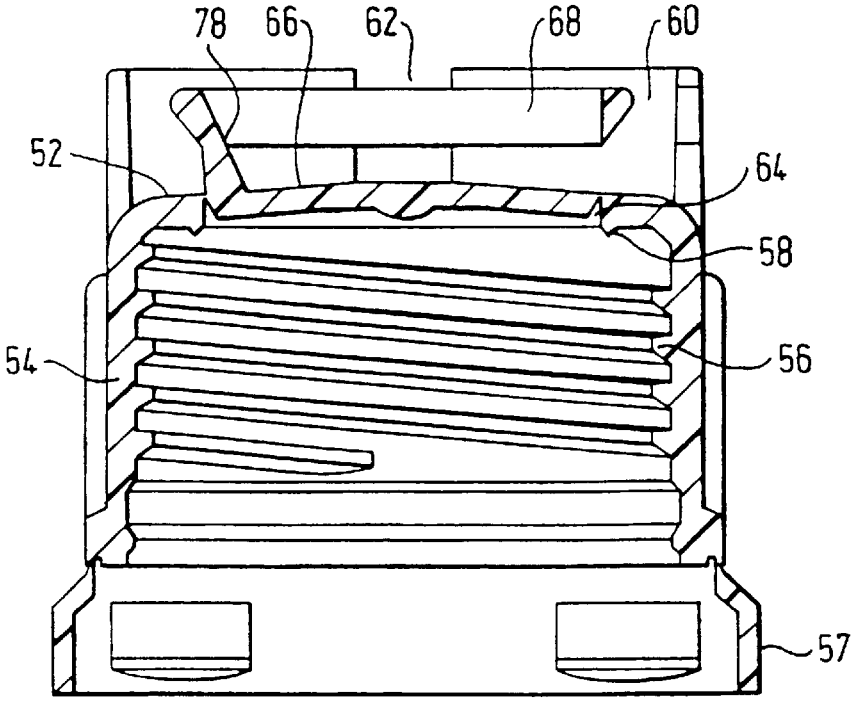
FIG. 7 is a cross-sectional view taken along the line VII—VII in FIG. 6.

A cap for use in a second embodiment of the invention is shown in FIGS. 5 to 7. The cap is generally similar to that used in the first embodiment of the package, and corresponding features are indicated by corresponding reference numerals.

As in the first embodiment, the cap has a pull-ring attached to a removable region. However, in contrast to the first embodiment, the pull-ring is attached by a single leg 78. In addition, the upstanding members 72, 74 are omitted. As a result of the absence of the upstanding member 72, the removable region must be removed without using the leverage effect as previously described. However, the absence of the upstanding member 74 can make it easier for a user to hook a finger under the pull-ring, as there is no need to avoid the upstanding member or to break the ring from it.

Further, the line of weakness 64 is formed as a groove in the underside of the cover member 52 of the cap, rather than in the upper surface of the cover member 52, as in the first embodiment. This improves the appearance of the cap, and can also serve to improve the overall sterility of the package, as it removes the risk of contaminants collecting in the upwardly-facing groove. It should also be noted that the cover member of the cap is formed with its central region higher than its periphery, to assist drainage of water. This is best shown in FIG. 7.

Figure 8:
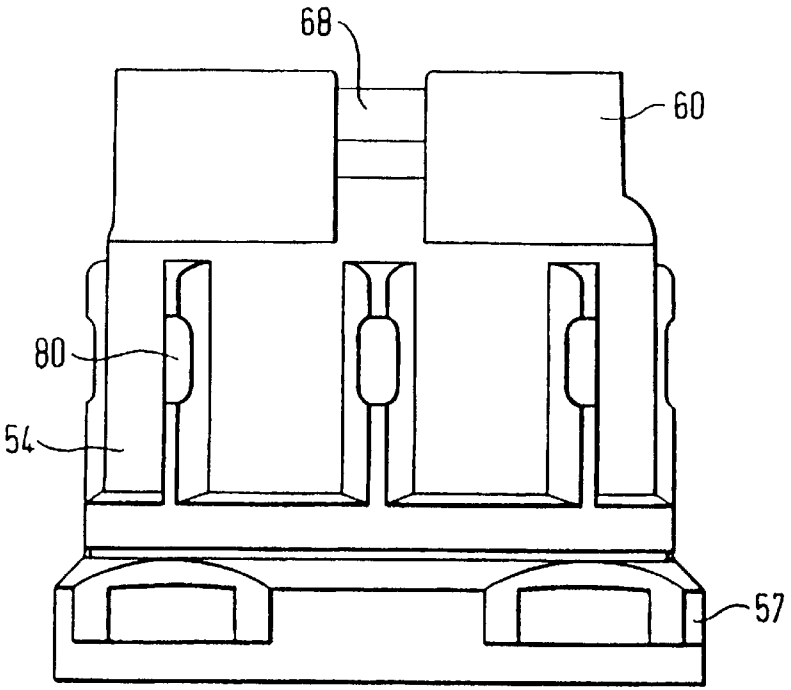
FIG. 8 is a side view of an alternative cap.

An alternative cap is shown in FIG. 8. This cap is provided with snap fits 80 to allow it to engage with an injector.

What is claimed is:

1. A package comprising a container with a mouth, a stopper removably inserted into said mouth, and a cap overlying said stopper, said cap comprising a removable portion which can be removed to gain access to said stopper, and an engageable member for operation by a user to remove the removable portion, said cap comprising a wall extending generally about the periphery of the engageable member to protect it from accidental operations or entanglement, said wall having at least one opening therethrough, and wherein said container and said cap are formed from plastics material.

2. A package as claim in claim 1, wherein said engageable member comprises a ring upwardly spaced from the removable portion.

3. A package as claimed in claim 1, wherein said cap comprises at least one projection, which acts as a pivot for said engageable member.

4. A package as claimed in claim 1, wherein said cap is provided with a member which engages with said stopper when said package is closed to protect a defined region of said stopper from contamination.

5. A package as claimed in claim 1, wherein said mouth has an internal diameter, and wherein said container has a region below said mouth having an internal diameter less than the internal diameter of said mouth.

6. A package as claimed in claim 1, wherein said cap is provided with a tamper-evident member which is removably attached to the cap.

7. A package as claimed in claim 6, wherein said tamper-evident member is a ring which engages beneath a lip of the container.

8. A package comprising a container with a mouth, a stopper removably inserted into said mouth, and a cap overlying said stopper, wherein said cap comprises a removable portion which can be removed to gain access to said stopper, an engageable member for operation by a user to remove the removable portion, and a wall extending generally about the periphery of the engageable member to protect it from accidental operation or entanglement, wherein said wall has at least one opening therethrough.

9. A package as claimed in claim 8, wherein said engageable member comprises a ring upwardly spaced from the removable portion.

10. A package as claimed in claim 8, wherein said cap comprises at least one projection, which acts as a pivot for said engageable member.

11. A package as claimed in claim 8, wherein said cap is provided with a member which engages with said stopper when said package is closed to protect a defined region of said stopper from contamination.

12. A package as claimed in claim 8, wherein said mouth has an internal diameter, and wherein said container has a region below said mouth having an internal diameter less than the internal diameter of said mouth.

13. A package as claimed in claim 8, wherein said cap is provided with a tamper-evident member which is removably attached to the cap.

14. A package as claimed in claim 13, wherein said tamper-evident member is a ring which engages beneath a lip of the container.

15. A package comprising a container with a mouth, a stopper removably inserted into said mouth, and a cap overlying said stopper, wherein said container and said cap are formed from plastics material, wherein said cap comprises a removable portion which can be removed to gain access to said stopper, and an engageable member for operation by a user to remove the removable portion and wherein said cap further comprises at least one projection, which acts as a pivot for said engageable member.

* * * * *